United States Patent [19]

Pienkowski

[11] 3,995,931

[45] Dec. 7, 1976

[54] TERMINAL FOR APERTURED CIRCUIT PANEL

[75] Inventor: Stanley A. Pienkowski, Glendale Heights, Ill.

[73] Assignee: Molex Incorporated, Lisle, Ill.

[22] Filed: Mar. 26, 1975

[21] Appl. No.: 562,340

[52] U.S. Cl. ..... 339/217 S; 339/252 P

[51] Int. Cl.[2] ..... H01R 11/08

[58] Field of Search ..... 339/217 R, 217 S, 275 R, 339/275 B, 275 T, 276 R, 276 T, 17 R, 17 C, 252 P

[56] References Cited

UNITED STATES PATENTS

| | | | |
|---|---|---|---|
| 2,877,441 | 3/1959 | Narozny | 339/217 S |
| 3,032,741 | 5/1962 | Gerald | 339/252 P |
| 3,072,880 | 1/1963 | Olsson | 339/217 S |
| 3,189,868 | 6/1965 | Hatfield | 339/252 P |
| 3,808,588 | 4/1974 | McGregor | 339/217 S |

*Primary Examiner*—Joseph H. McGlynn
*Assistant Examiner*—Howard N. Goldberg
*Attorney, Agent, or Firm*—Louis A. Hecht

[57] ABSTRACT

A crimp-type terminal adapted to be electrically connected to the conductors of a wire and inserted into an aperture formed in a circuit panel. The terminal includes an elongated tapered nose section adapted to be received through the aperture. The nose section has a central conductor support area for supporting the conductors of the wire which are surrounded by a rear portion and a forward conductor gripping portion. The conductors are partially exposed between the forward and rear portions after the nose section is inserted through the aperture. When the circuit panel is wave soldered, the solder material adheres directly to the exposed conductors.

5 Claims, 5 Drawing Figures

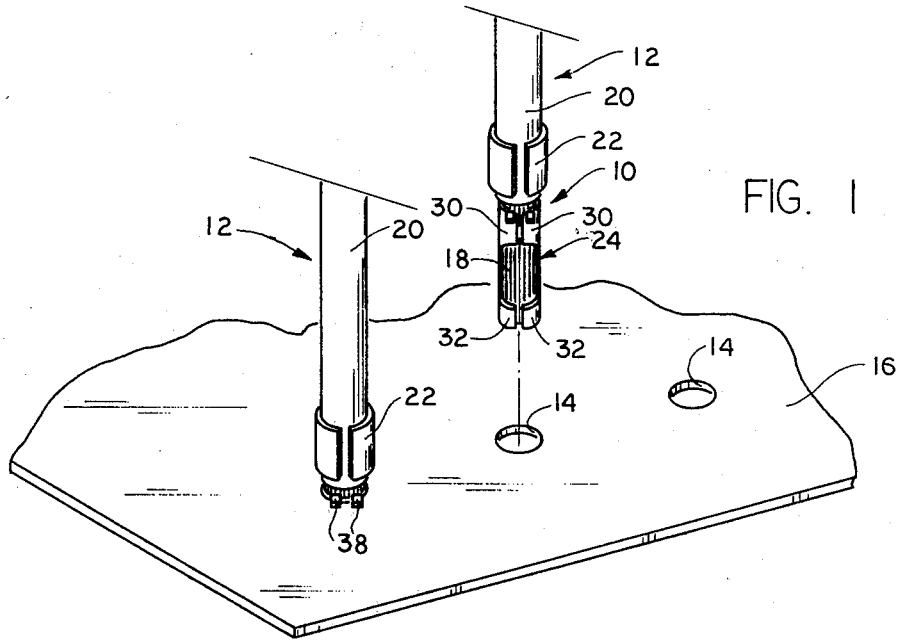
FIG. 1
FIG. 2
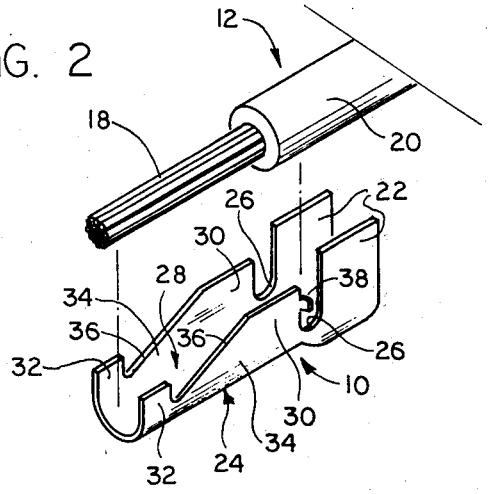
FIG. 4
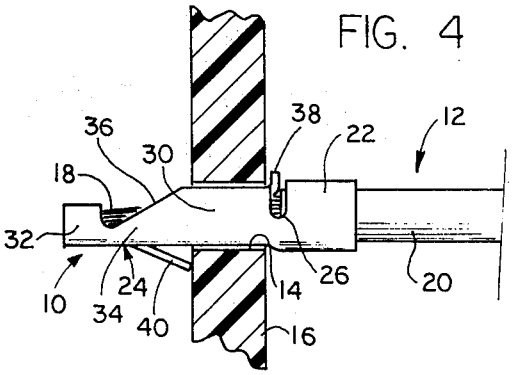
FIG. 3
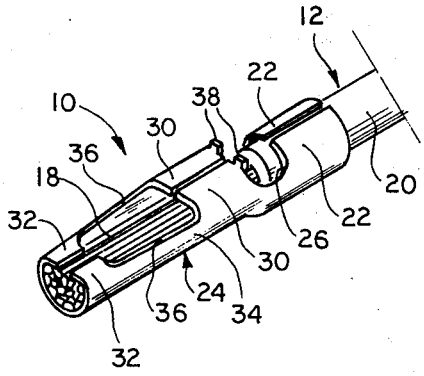
FIG. 5
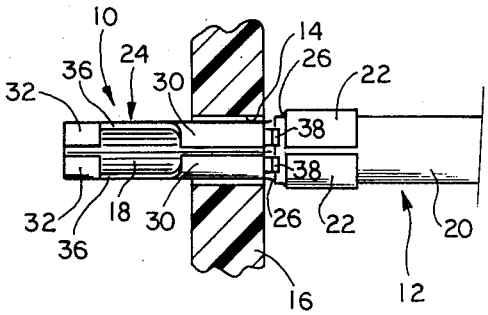

TERMINAL FOR APERTURED CIRCUIT PANEL

BACKGROUND OF THE INVENTION

1. Field of the Invention

The present invention generally relates to electric terminals.

2. Brief Description of the Prior Art

Electrical terminals for apertured circuit panels such as printed circuit boards are well known in the art. Typically, a terminal of this type is inserted in an aperture in a printed circuit board which has conductive material extending between the aperture and another portion of the board. The terminal is usually crimped onto an insulation clad wire. Thus, by inserting the terminal into the aperture, one is able to complete an electrical connection between the wire and the other portion of the printed circuit board.

A printed circuit board having terminals of this type inserted therein are usually wave-soldered. Because the terminal usually completely covers and shields the conductors of the wire, electricity must flow from the wire conductor through the terminal, through the solder, and to the conductive material on the printed circuit board. It has been found that although such a connection is usually satisfactory, the resistivity of all the material through which the electricity must flow can impair the electrical connection.

SUMMARY OF THE INVENTION

It is therefore the principal object of the present invention to provide a new and improved crimp-type terminal adapted to be electrically connected to the conductors of a wire and inserted into an aperture formed in a circuit panel whereby the resistivity is lower than heretofore been known after soldering.

This and other objects of the present invention are accomplished by providing the terminal with an elongated tapered nose section adapted to be received through a circuit panel aperture. The nose section includes a central conductor support area for supporting the conductors of the wire which are surrounded by a rear portion and a forward conductor gripping portion. The conductors are at least partially exposed between the forward and rear portions after the nose section is inserted through the aperture. Thus, when the circuit panel is wave soldered, the solder material comes in direct contact with the exposed wire conductors.

BRIEF DESCRIPTION OF THE DRAWINGS

FIG. 1 is a perspective view of an apertured circuit panel showing two terminated wire leads employing the terminal of the present invention;

FIG. 2 is a perspective view of a stripped wire lead preparatory to its placement in a formed terminal blank prior to crimping;

FIG. 3 is a perspective view of a terminated wire lead employing the terminal of the present invention;

FIG. 4 is a side sectional view of a circuit panel showing the terminal of the present invention inserted through an aperture; and FIG. 5 is a side sectional view of a circuit panel showing the terminal of the present invention taken in a direction generally ninety degrees from that of FIG. 4.

DESCRIPTION OF THE PREFERRED EMBODIMENT

Turning now to FIG. 1 in greater detail, a crimp-type terminal, generally designated 10, is shown crimped onto a wire, generally designated 12, which is adapted to be inserted into an aperture 14 formed in a circuit panel 16. The wire is of the insulation clad type having a plurality of central conductors 18 surrounded by insulation 20. Prior to crimping, a portion of the insulation 20 is stripped away exposing thereby a given length of the conductors 18 (FIG. 2).

The terminal 10 is seen to generally include an insulation crimp section 22 which is adapted to grip the insulation 20 adjacent the stripped portion of the wire 12 and a tapered nose section, generally designated 24, which is adapted to be inserted through an aperture 14. The insulation crimp section 22 and the tapered nose section 24 are separated by spaces 26.

Turning now to the nose section 24 in greater detail, there is provided a conductor supporting area 28 (FIG. 2) where the exposed conductors 18 are intended to be supported. Extending from either side of the supporting area 28 are a pair of rear wings 30, a pair of forward wings 32, and a pair of reduced intermediate portions 34 between said rear wings 30 and forward wings 32. The forward wings 32 are adapted to wrap around and grip the conductors 18 after the crimping operation defining thereby a forward conductor gripping portion. The rear wings 30 do not grip the conductors 18 but give the terminal structural stability.

The reduced intermediate portions have edges 36. The edges 36 define an area between the rear wings 30 and forward wings 32, which expose a portion of the conductors 18 after the crimping operation. The edges 36 also serve as a ramp to aid in inserting the terminal into an aperture 14.

The terminal 10 is adapted to be snap-fit into an aperture 14 and held in place preparatory to wave soldering. In order to hold the terminal 10 in such a fashion, there is provided a pair of forward stop tabs 38 one formed on each of the rear wings 30 to limit the forward insertion of the nose section 24 and a rear stop tang 40 formed on the bottom of the supporting area 28 between the intermediate portions 34 to prevent withdrawal of the nose section 24 after insertion. Forward stop tabs 38 are adapted to abut on one side of the circuit panel 16 whereas the rear stop tang 40 is adapted to abut the other side of circuit panel 16 as best shown in FIG. 4.

The distance between the forward stop tabs 38 and rear stop tang 40 is substantially that of the length of the rear wings 30 which are in turn substantially the same length as the thickness of the circuit panel 16. Then, when the terminal 10 is inserted into an aperture 14, the rear wings 30 are substantially coextensive with the thickness of the circuit panel 16, leaving the intermediate portions 34 and forward wings 32 extending out of the other side of the circuit panel 16.

After the terminal 10 is fully inserted into the circuit panel 16 through an aperture 14 as best shown in FIGS. 4 and 5, the circuit panel 16 is then wave soldered. Because a portion of the wire conductors 18 are exposed on the side of the circuit panel 16 which is subject to wave soldering, the solder material will directly contact the conductors 18. This ensures a better connection with less resistivity.

We claim:

1. A crimp-type terminal adapted to be electrically connected to the conductors of a wire and inserted into an aperture formed in a circuit panel, said terminal comprising:

an elongated nose section adapted to be received through said aperture, said nose section including a central conductor support area for supporting the conductors of the wire, a pair of rear wings extending outwardly in opposite directions from the support area around the conductors to substantially conform with the cross section of the aperture, a pair of forward wings extending outwardly in opposite directions from the support area around the conductors in a gripping fashion, and a pair of reduced intermediate portions between said forward and rear wings, each having an edge, said intermediate portions extending a sufficiently small distance from said central conductor support area so that when said nose section is formed around said wire conductors, said edges will define an exposed area between said forward and rear wings, the cross section of the nose section at the rear wings being greater than the cross section of the nose section at the forward wings, said intermediate portions extending from said central conductor support area a distance of varying gradual length from said rear wings toward said forward wings, the edges of said intermediate portions defining a ramp to aid in the insertion of the nose section through the aperture.

2. The terminal of claim 1 wherein the length of the rear wings is substantially the same as the thickness of the circuit panel so that the rear portion is substantially coextensive with the thickness of the circuit panel when the terminal is inserted into the aperture.

3. The terminal of claim 2 including forward stop means formed on the rear wings to limit the forward insertion of the terminal and rear stop means formed on the bottom of the support area adjacent the intermediate portions to prevent withdrawal of the terminal after insertion.

4. The terminal of claim 3 wherein said forward stop means includes a tab formed on each rear wing, each adapted to abut a surface of the circuit panel adjacent the aperture when said terminal is inserted and said rear stop means includes a tang struck out from the bottom of the support area adjacent the intermediate portions that is adapted to abut the opposite surface of the circuit panel adjacent the aperture after said terminal is inserted.

5. The terminal of claim 1 including an insulation gripping section adapted to grip the insulation of an insulation clad wire.

* * * * *